US011440159B2

(12) United States Patent
Pai et al.

(10) Patent No.: US 11,440,159 B2
(45) Date of Patent: Sep. 13, 2022

(54) EDGE LOAD RING

(71) Applicant: Applied Materials, Inc., Santa Clara, CA (US)

(72) Inventors: Uday Pai, San Jose, CA (US); Jeonghoon Oh, Saratoga, CA (US); Van H. Nguyen, Milpitas, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 0 days.

(21) Appl. No.: 17/034,541

(22) Filed: Sep. 28, 2020

(65) Prior Publication Data

US 2022/0097202 A1 Mar. 31, 2022

(51) Int. Cl.
*B24B 37/32* (2012.01)
*B24B 37/30* (2012.01)

(52) U.S. Cl.
CPC ..... *B24B 37/32* (2013.01); *B24B 37/30* (2013.01)

(58) Field of Classification Search
CPC ..... B24B 37/30; B24B 37/32; B25B 11/005
USPC ..... 451/398, 388
See application file for complete search history.

(56) References Cited

U.S. PATENT DOCUMENTS 6,089,961 A * 7/2000 Cesna ..... B24B 37/32 451/287
6,132,298 A * 10/2000 Zuniga ..... B24B 37/30 451/41
6,244,942 B1 * 6/2001 Zuniga ..... B24B 37/32 451/288
6,358,121 B1 * 3/2002 Zuniga ..... B24B 37/30 451/388
6,361,420 B1 * 3/2002 Zuniga ..... B24B 37/30 451/288
6,450,868 B1 * 9/2002 Zuniga ..... B24B 37/30 451/388
6,494,774 B1 * 12/2002 Zuniga ..... B24B 37/30 451/41

(Continued)

FOREIGN PATENT DOCUMENTS

JP 5467937 B2 4/2014
KR 100826590 B1 4/2008

OTHER PUBLICATIONS

International Search Report dated Nov. 24, 2021 for Application No. PCT/US2021/044499.

*Primary Examiner* — Joseph J Hail
*Assistant Examiner* — Jonathan R Zaworski
(74) *Attorney, Agent, or Firm* — Patterson + Sheridan LLP

(57) ABSTRACT

Apparatus and methods relating to chemical mechanical polishing (CMP) are described herein. An edge load ring (ELR) is configured to fit inside a retaining ring of a CMP head. The ELR includes an annular body having an inner surface and an outer surface opposite the inner surface, the outer surface having a diameter configured to slip inside a retaining ring. The annular body includes a body portion formed from a first material and a bottom projection extending below the body portion. The bottom projection has a bottom surface facing away from the body portion, and the bottom projection is formed form a second material different from the first material. The annular body includes a venting feature formed through the annular body, the venting feature being in fluid communication between the inner and outer surfaces.

20 Claims, 4 Drawing Sheets

(56) References Cited

U.S. PATENT DOCUMENTS

| | | | | |
|---|---|---|---|---|
| 6,569,771 | B2 * | 5/2003 | Lin | B24B 37/30 438/692 |
| 6,821,192 | B1 | 11/2004 | Donohue | |
| 6,872,130 | B1 * | 3/2005 | Zuniga | B24B 37/30 451/287 |
| 6,890,249 | B1 * | 5/2005 | Zuniga | B24B 37/32 451/399 |
| 6,905,392 | B2 * | 6/2005 | Bottema | B24B 37/0053 451/5 |
| 7,074,118 | B1 * | 7/2006 | Bottema | B24B 49/16 451/288 |
| 7,186,171 | B2 * | 3/2007 | Oh | B24B 37/32 451/285 |
| 7,677,958 | B2 * | 3/2010 | Marohl | B24B 37/32 451/442 |
| 7,740,521 | B2 * | 6/2010 | Hashimoto | B24B 37/30 451/41 |
| 8,721,391 | B2 * | 5/2014 | Chen | B24B 37/32 451/63 |
| 11,260,500 | B2 * | 3/2022 | Chen | B24B 37/32 |
| 11,325,223 | B2 * | 5/2022 | Zuniga | B24B 37/32 |
| 2009/0023368 | A1 * | 1/2009 | Wu | B24B 37/042 451/36 |
| 2018/0304441 | A1 | 10/2018 | Chen et al. | |
| 2021/0053182 | A1 * | 2/2021 | Zuniga | B24B 37/32 |

* cited by examiner

EDGE LOAD RING

BACKGROUND

Field

Embodiments described herein generally relate to chemical mechanical polishing (CMP) systems and processes used in the manufacturing of electronic devices. In particular, embodiments herein relate to an edge load ring (ELR) for CMP polishing heads.

Description of the Related Art

Chemical mechanical polishing (CMP) is commonly used in the manufacturing of semiconductor devices to planarize or polish a layer of material deposited on a crystalline silicon (Si) substrate surface. In a typical CMP process, the substrate is retained in a polishing head which presses the feature side of the substrate against a rotating polishing pad in the presence of a polishing fluid. Generally, the polishing fluid comprises an aqueous solution of one or more chemical constituents and nanoscale abrasive particles suspended in the aqueous solution. Material is removed across the material layer surface of the substrate in contact with the polishing pad through a combination of chemical and mechanical activity which is provided by the polishing fluid and the relative motion of the substrate and the polishing pad.

CMP may also be used in the preparation of crystalline silicon carbide (SiC) substrates which, due to the unique electrical and thermal properties thereof, provide superior performance to Si substrates in advanced high power and high frequency semiconductor device applications. The SiC substrate is typically sliced from a single crystal ingot to provide circular shaped wafer having a silicon terminated surface (Si surface) and a carbon terminated surface (C surface), that is opposite of the Si surface. Each of the Si surface and the C surface are then typically processed to a desired thickness and surface finish using a combination of grinding, lapping, and CMP processing operations. For example, a CMP process may be used to planarize one or both of the Si surface and C surface, to remove sub-surface damage caused by the previous grinding and/or lapping operations, and/or to prepare the SiC substrate for subsequent epitaxial SiC growth thereon.

The polishing head includes a membrane having a plurality of different radial zones that contact the substrate. The membrane may include three or more zones, such as from 3 zones to 11 zones, for example, 3, 5, 7 or 11 zones. Using the different radial zones, pressure applied to a chamber bounded by the back side of the membrane may be selected to control the center to edge profile of force applied by the membrane to the substrate, and consequently, to control the center to edge profile of force applied by the substrate against the polishing pad.

The polishing head includes an edge load ring (ELR) surrounding the membrane. Pressure applied to the chamber may be selected to control force applied by the ELR to a perimeter portion of the substrate, and consequently, the profile of force applied by the perimeter portion of the substrate against the polishing pad. Even using the aforementioned pressure control, a persistent problem in CMP operations is the occurrence of an edge effect, i.e., the over- or under-polishing of the outermost 5-10 mm of a substrate.

Accordingly, what is needed in the art are apparatus and methods for solving the problems described above.

SUMMARY

Embodiments described herein generally relate to chemical mechanical polishing (CMP) systems and processes used in the manufacturing of electronic devices. In particular, embodiments herein relate to an edge load ring (ELR) for CMP polishing heads.

In one embodiment, an edge load ring (ELR) is configured to fit inside a retaining ring of a CMP head. The ELR includes an annular body having an inner surface and an outer surface opposite the inner surface, the outer surface having a diameter configured to slip inside a retaining ring. The annular body includes a body portion formed from a first material and a bottom projection extending below the body portion. The bottom projection has a bottom surface facing away from the body portion, and the bottom projection is formed form a second material different from the first material. The annular body includes a venting feature formed through the annular body, the venting feature being in fluid communication between the inner and outer surfaces.

In another embodiment, an ELR is configured to fit inside a retaining ring of a CMP head. The ELR includes an annular body having an inner surface, the inner surface having a step configured to retain the annular body within the polishing head. The annular body includes an outer surface opposite the inner surface, the outer surface having a diameter configured to slip inside a retaining ring. The annular body includes a bottom surface extending between the inner and outer surfaces, the bottom surface configured to contact a substrate disposed in the polishing head. The annular body includes a venting feature extending between the inner and outer surfaces.

In yet another embodiment, a polishing head includes a housing, a retaining ring coupled to the housing, and a membrane coupled to the housing inside the retaining ring, the membrane and the retaining ring forming a substrate-receiving pocket. The polishing head includes an ELR disposed radially between the membrane and the retaining ring, the ELR including an annular body. The annular body has an inner surface having a step configured to retain the annular body within the polishing head. The annular body includes an outer surface opposite the inner surface, the outer surface having a diameter configured to slip inside the retaining ring. The annular body includes a bottom surface extending between the inner and outer surfaces, the bottom surface configured to contact a substrate disposed in the substrate-receiving pocket. The annular body includes a venting feature extending between the inner and outer surfaces.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Before describing several exemplary embodiments of the apparatus and methods, it is to be understood that the disclosure is not limited to the details of construction or process steps set forth in the following description. It is envisioned that some embodiments of the present disclosure may be combined with other embodiments.

One or more embodiments of the present disclosure relate to chemical mechanical polishing (CMP) systems and processes used in the manufacturing of electronic devices. In particular, one or more embodiments of the present disclosure are directed towards an edge load ring (ELR) for CMP polishing heads. In some embodiments, an ELR is configured to fit inside a retaining ring of a CMP head. The ELR includes an annular body having an inner surface and an outer surface opposite the inner surface, the outer surface having a diameter configured to slip inside a retaining ring. The annular body includes a body portion formed from a first material and a bottom projection extending below the body portion. The bottom projection has a bottom surface facing away from the body portion, and the bottom projection is formed form a second material different from the first material. The annular body includes a venting feature formed through the annular body, the venting feature being in fluid communication between the inner and outer surfaces.

In one or more embodiments of the present disclosure, the venting feature equalizes pressure between the inner and outer surfaces of the ELR by providing fluid communication therethrough to increase a pressure of a sealed volume formed between the inner surface, a membrane in contact with the inner surface, and a substrate in contact with the bottom surface. Beneficially, pressure equilibration across the ELR prevents undesirable sticking between the ELR and the substrate improving the CMP operation.

Figure 1A:
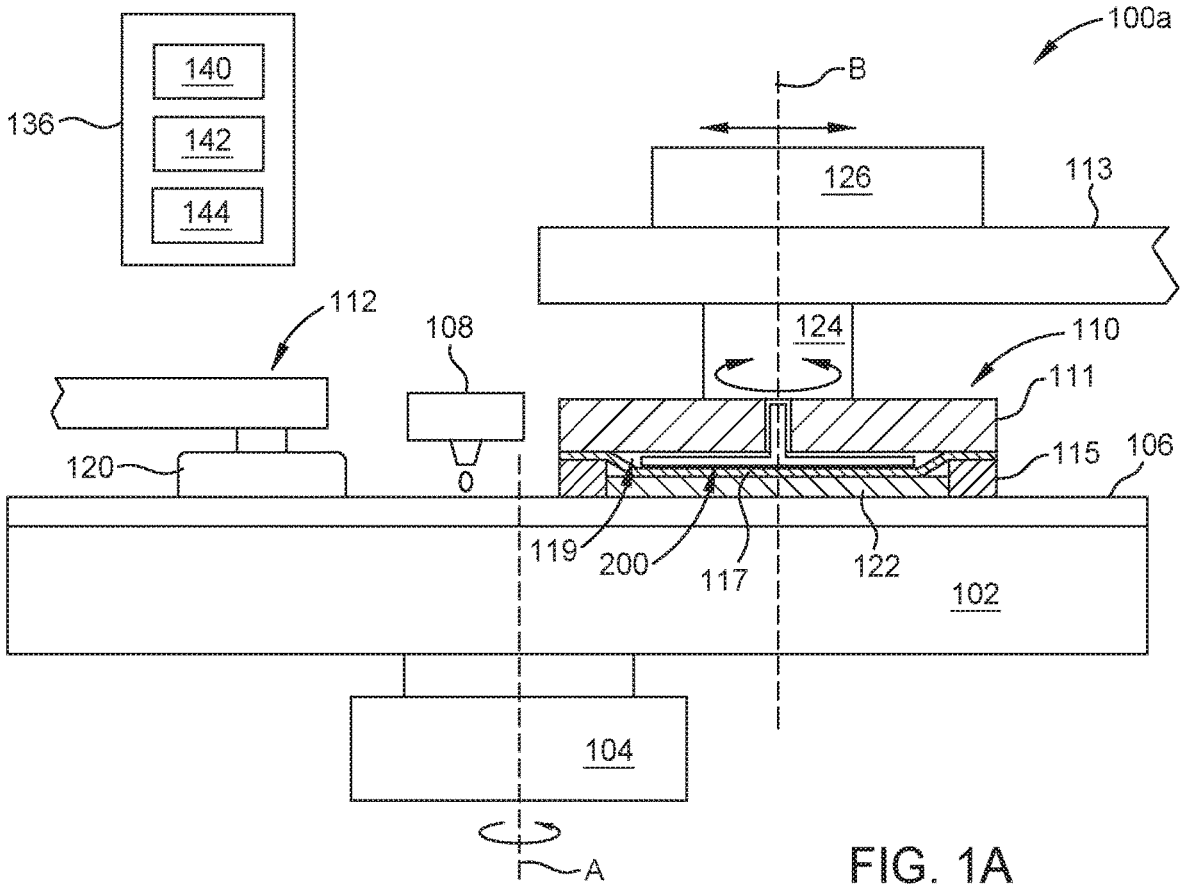
FIG. 1A is a schematic side view of an exemplary polishing station which may be used to practice the methods set forth herein, according to one or more embodiments.
Figure 1B:
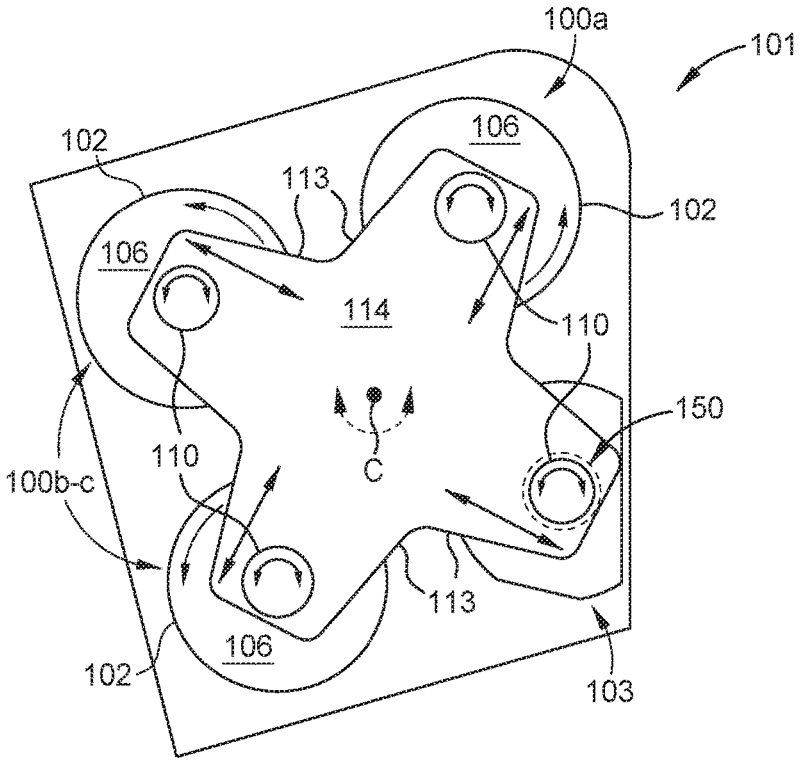
FIG. 1B is a schematic plan view of a portion of a multi-station polishing system which may be used to practice the methods set forth herein, according to one or more embodiments.

FIG. 1A is a schematic side view of a polishing station 100*a*, according to one or more embodiments, which may be used to practice the methods set forth herein. FIG. 1B is a schematic plan view of a portion of a multi-station polishing system 101 comprising a plurality of polishing stations 100*a-c*, where each of the polishing stations 100*b-c* are substantially similar to the polishing station 100*a* described in FIG. 1A. In FIG. 1B at least some of the components with respect to the polishing station 100*a* described in FIG. 1A are not shown on the plurality of polishing stations 100*a-c* in order to reduce visual clutter. Polishing systems that may be adapted to benefit from the present disclosure include MIRRA®, MIRRA MESA®, and DURUM™ Planarizing Systems, available from Applied Materials, Inc. of Santa Clara, Calif., among others.

As shown in FIG. 1A, the polishing station 100*a* includes a platen 102, a first actuator 104 coupled to the platen 102, a polishing pad 106 disposed on the platen 102 and secured thereto, a fluid delivery arm 108 disposed over the polishing pad 106, a polishing head 110 (shown in cross-section), and a pad conditioner assembly 112. Here, the polishing head 110 is suspended from a carriage arm 113 of a carriage assembly 114 (FIG. 1B) so that the polishing head 110 is disposed over the polishing pad 106 and faces there towards. The carriage assembly 114 is rotatable about a carriage axis C to move the polishing head 110, and thus a substrate 122 chucked therein, between a loading station 103 (FIG. 1B) and/or between polishing stations 100*a-c* of the multi-station polishing system 101. The loading station 103 includes a load cup 150 (shown in phantom) for loading a substrate 122 to the polishing head 110.

During substrate polishing, the first actuator 104 is used to rotate the platen 102 about a platen axis A and the polishing head 110 is disposed above the platen 102 and faces there towards. The polishing head 110 is used to urge a to-be-polished surface of a substrate 122 (shown in phantom), disposed therein, against the polishing surface of the polishing pad 106 while simultaneously rotating about a carrier axis B. Here, the polishing head 110 includes a housing 111, an annular retaining ring 115 coupled to the housing 111, a membrane 117 spanning the inner diameter of the retaining ring 115, and substrate backing assembly 200 disposed between the housing 111 and the membrane 117. The retaining ring 115 surrounds the substrate 122 and prevents the substrate 122 from slipping from the polishing head 110 during polishing. The membrane 117 is used to apply a downward force to the substrate 122 and for loading (chucking) the substrate into the polishing head 110 during substrate loading operations and/or between substrate polishing stations. For example, during polishing, a pressurized gas is provided to a carrier chamber 119 to exert a downward force on the membrane 117 and thus a downward force on the substrate 122 in contact therewith. Before and after polishing, a vacuum may be applied to the carrier chamber 119 so that the membrane 117 is deflected upwards to create a low pressure pocket between the membrane 117 and the substrate 122, thus vacuum-chucking the substrate 122 into the polishing head 110.

The substrate 122 is urged against the pad 106 in the presence of a polishing fluid provided by the fluid delivery arm 108. Typically, the rotating polishing head 110 oscillates between an inner radius and an outer radius of the platen 102 to, in part, reduce uneven wear of the surface of the polishing pad 106. Here, the polishing head 110 is rotated using a first actuator 124 and is oscillated using a second actuator 126.

Here, the pad conditioner assembly 112 comprises a fixed abrasive conditioning disk 120, e.g., a diamond impregnated disk, which may be urged against the polishing pad 106 to rejuvenate the surface thereof and/or to remove polishing byproducts or other debris therefrom. In other embodiments, the pad conditioner assembly 112 may comprise a brush (not shown).

Here, operation of the multi-station polishing system 101 and/or the individual polishing stations 100*a-c* thereof is facilitated by a system controller 136 (FIG. 1A). The system controller 136 includes a programmable central processing unit (CPU 140) which is operable with a memory 142 (e.g., non-volatile memory) and support circuits 144. The support circuits 144 are conventionally coupled to the CPU 140 and comprise cache, clock circuits, input/output subsystems, power supplies, and the like, and combinations thereof coupled to the various components of the polishing system 101, to facilitate control of a substrate polishing process. For example, in some embodiments the CPU 140 is one of any form of general purpose computer processor used in an industrial setting, such as a programmable logic controller (PLC), for controlling various polishing system component and sub-processors. The memory 142, coupled to the CPU 140, is non-transitory and is typically one or more of readily available memory such as random access memory (RAM), read only memory (ROM), floppy disk drive, hard disk, or any other form of digital storage, local or remote.

Herein, the memory 142 is in the form of a computer-readable storage media containing instructions (e.g., non-volatile memory), that when executed by the CPU 140, facilitates the operation of the polishing system 101. The instructions in the memory 142 are in the form of a program product such as a program that implements the methods of the present disclosure (e.g., middleware application, equipment software application etc.). The program code may conform to any one of a number of different programming languages. In one example, the disclosure may be implemented as a program product stored on computer-readable storage media for use with a computer system. The program(s) of the program product define functions of the embodiments (including the methods described herein).

Illustrative computer-readable storage media include, but are not limited to: (i) non-writable storage media (e.g., read-only memory devices within a computer such as CD-ROM disks readable by a CD-ROM drive, flash memory, ROM chips or any type of solid-state non-volatile semiconductor memory) on which information is permanently stored; and (ii) writable storage media (e.g., floppy disks within a diskette drive or hard-disk drive or any type of solid-state random-access semiconductor memory) on which alterable information is stored. Such computer-readable storage media, when carrying computer-readable instructions that direct the functions of the methods described herein, are embodiments of the present disclosure.

Figure 2A:
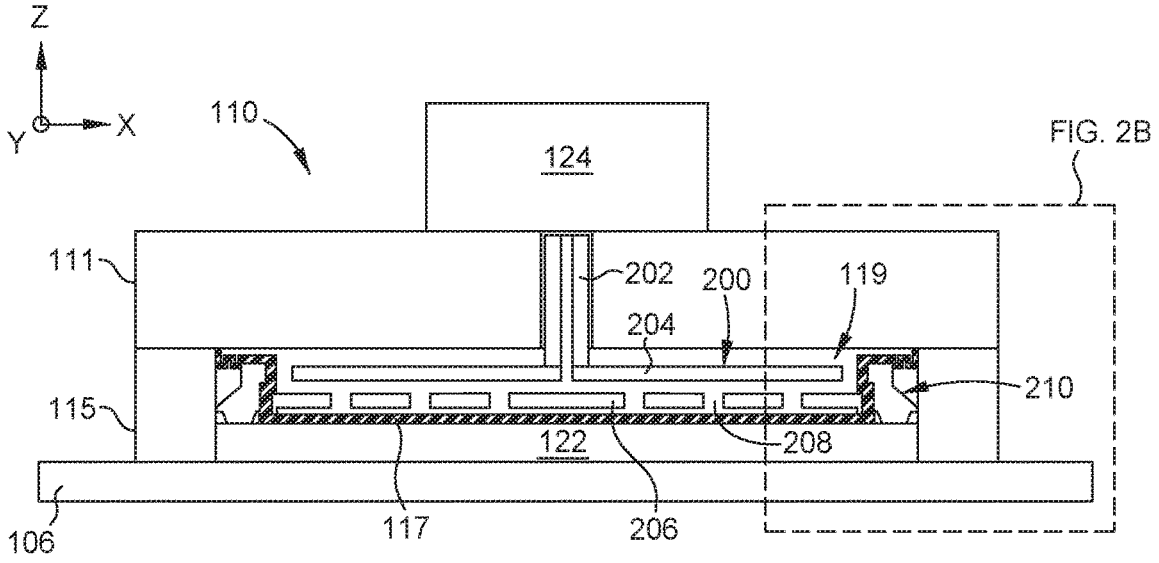
FIG. 2A is a schematic side view of one embodiment of a polishing head that may be used in the polishing system of FIG. 1B.
Figure 2C:
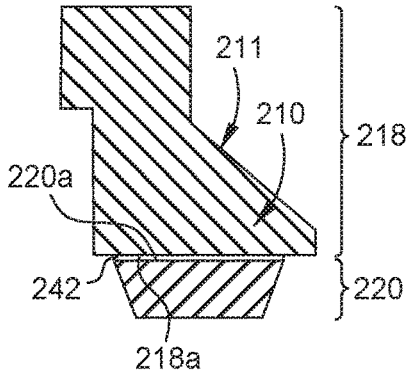
FIGS. 2C-2D are enlarged side sectional views of an exemplary ELR that may be used in the polishing head of FIG. 2A.
Figure 2B:
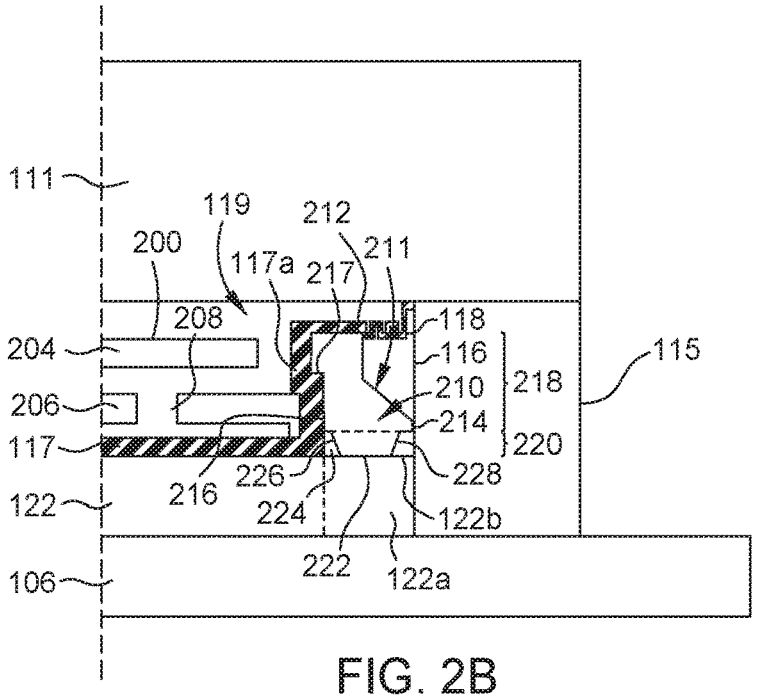
FIG. 2B is an enlarged schematic side view of a portion of FIG. 2A.

FIG. 2A is a schematic side view of one embodiment of a polishing head 110 that may be used in the polishing system 101 of FIG. 1B. FIG. 2B is an enlarged schematic side view of a portion of FIG. 2A. In particular, FIGS. 2A-2B illustrate the substrate backing assembly 200 in more detail. The substrate backing assembly 200 generally includes a gimbal rod 202 extending through the housing 111, a flexure ring 204 pivotally coupled to a distal end of the gimbal rod 202, and a support plate 206 coupled a bottom edge of the flexure ring 204. The carrier chamber 119 provides fluid and pressure communication between the gimbal rod 202 and the membrane 117 via a plurality of apertures 208 formed through the support plate 206. An edge load ring (ELR) 210 extends around the substrate backing assembly 200 and engages a perimeter portion 122*a* of the substrate 122. Here, the perimeter portion 122*a* of the substrate 122 extends radially between the membrane 117 and the retaining ring 115. In some other embodiments, the perimeter portion 122*a* is defined as an outer annular region of the substrate 122, such as the outer 20 mm thereof. Pressurization of the carrier chamber 119 pushes the ELR 210 downward against the perimeter portion 122*a* of the substrate 122 forcing the perimeter portion 122*a* of the substrate 122 against the polishing pad 106.

Figure 2D:
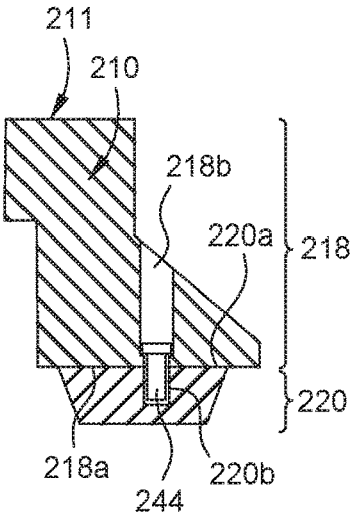

The ELR 210 includes an annular body 211 having a body portion 218 and a bottom projection 220. In some embodiments, the body portion 218 and bottom projection 220 are integrally formed, i.e., formed from a single mass of material. In some other embodiments, the body portion 218 and bottom projection 220 are separately formed and coupled together (FIGS. 2C-2D). The membrane 117 extends over a top face 212 of the annular body 211. Pressure in the carrier chamber 119 is applied to the annular body 211 through the interface formed between the membrane 117 and the top face 212. In some embodiments, the membrane 117 is coupled to the housing 111, the retaining ring 115, or both, by a flexible seal 118, e.g., a bellows seal, to allow vertical movement of the ELR 210 relative to the housing 111. The annular body 211 has an outer surface 214 facing an inner surface 116 of the retaining ring 115. The outer surface 214 has a diameter configured to slip inside the inner surface 116 of the retaining ring 115. In some embodiments, contact between the outer surface 214 and the inner surface 116 restrains radial movement of the ELR 210 and helps to retain the ELR 210 beneath the polishing head 110. The annular body 211 has an inner surface 216 contacting a vertical portion 117*a* of the membrane 117 for forming a sealing engagement therebetween. The annular body 211 includes a radially inwardly extending step 217 formed along the inner surface 216. The step 217 forms a downward-facing shoulder which is supported on an upward-facing shoulder of the membrane 117 for retaining the annular body 211 within the polishing head 110.

The body portion 218 is formed from a relatively rigid material such as a metal, e.g., stainless steel or anodized aluminum, a ceramic, a plastic, e.g., polyphenylene sulfide (PPS) or polyethylene terephthalate (PET), other similar materials, or combinations thereof. In one or more embodiments, the body portion 218 is formed from a material having a tensile modulus of about 2,500 MPa or greater to prevent the annular body 211 from deforming under pressure.

The bottom projection 220 extends below the body portion 218. The bottom projection 220 has a bottom surface 222 facing away from the housing 111 and towards a back side 122*b* of the substrate 122 for engaging the perimeter portion 122*a*. Here, the bottom surface 222 is flat, e.g., being parallel to the back side 122*b* of the substrate 122. In some other embodiments, the bottom surface 222 is curved. The bottom projection 220 includes an inner taper 226 extending from the inner surface 216 to the bottom surface 222. Likewise, the bottom projection 220 includes an outer taper 228 extending from the outer surface 214 to the bottom surface 222. Here, the inner and outer tapers 226, 228 are straight. In some other embodiments, the inner and outer tapers 226, 228 are rounded. Here, the bottom projection 220 is an annular ring. In some other embodiments, the bottom projection 220 includes a plurality of arc-shaped projections. In some other embodiments, the bottom projection 220 includes a plurality of individual projections extending from the body portion 218, where the plurality of individual projections are radially and circumferentially spaced around the annular body 211.

The bottom projection 220 is formed from a relatively soft and/or compressible material compared to the body portion 218. In one or more embodiments, the bottom projection 220 is formed from a plastic, e.g., polyurethane (PU), polyethylene terephthalate (PET), polyether ether ketone (PEEK), polytetrafluoroethylene (PTFE), other similar materials, or combinations thereof. In some embodiments, the body portion 218 and bottom projection 220 are formed integrally from the same material including any of the materials described above without limitation. In some other embodiments, the body portion 218 and bottom projection 220 are formed separately and coupled together. In some embodiments where the body portion 218 is formed from a metal, the body portion 218 is machined and the bottom projection 220 is coupled to or molded onto the body portion 218. Alternatively, in embodiments where the body portion 218 is formed from a plastic, the body portion 218 and bottom projection 220 are coupled or co-molded together.

FIGS. 2C-2D are enlarged side sectional views of an exemplary ELR 210 where the body portion 218 and bottom projection 220 are separately formed. Referring to FIG. 2C, the bottom projection 220 is coupled to the body portion 218 using an adhesive 242. The adhesive 242 contacts a bottom face 218*a* of the body portion 218 and a top face 220*a* of the bottom projection 220 to form a secure attachment therebetween. Referring to FIG. 2D, the bottom projection 220 is coupled to the body portion 218 using a plurality of fasteners 244, e.g., screws. In some embodiments, the plurality of fasteners 244 are spaced circumferentially about the axis C. It will be appreciated that only one such fastener is shown in the sectional view of FIG. 2D. The body portion 218 includes a plurality of apertures 218*b*, e.g., counter bores, formed therethrough for receiving the plurality of fasteners 244 disposed therein. Each of the plurality of apertures 218*b* formed in the body portion 218 is aligned with a respective threaded bore 220*b* formed in the top face 220*a* of the bottom projection 220. Each of the plurality of fasteners 244 extending from the bottom face 218*a* of the body portion 218 is threaded to a respective threaded bore 220*b* of the bottom projection 220 to form a secure attachment therebetween.

In some embodiments, the back side 122*b* of the substrate 122 is sensitive to being scratched when contacted by a material having a hardness greater than the back side hardness. For example, in some embodiments, the body portion 218 has a hardness greater than the back side hardness. In order to prevent scratching of the back side 122*b*, the bottom projection 220 may be formed from a material having a hardness about equal to the back side hardness or less. For example, in some embodiments, the back side 122*b* of the substrate 122 is a carbon terminated surface (C surface) of a SiC substrate, and the bottom projection 220 has a hardness value about equal to the hardness of the C surface or less to prevent scratching thereof.

In embodiments with a non-compliant and/or non-compressible bottom projection 220, even when interfacing surfaces of the annular body 211 and the substrate 122 are substantially flat and within tolerance, the bottom surface 222 of the annular body 211 and the back side 122*b* of the substrate 122 make three point contact therebetween which leads to stress concentration at the interface. In order to distribute the downforce of the ELR 210 across a larger area of the substrate 122 and mitigate the stress concentration, the bottom projection 220 is formed from a material having greater compliance and/or compressibility compared to the body portion 218. In such embodiments, the material forming the bottom projection 220 has a stiffness above a threshold value to provide above a minimum functional downforce to the substrate 122.

In some embodiments, the bottom projection 220 structurally comprises a closed cell foam. In such embodiments, where the bottom surface 222 of the annular body 211 is contacting the substrate 122, a sealed volume 224 is formed between the substrate 122, the membrane 117 and the inner surface 216 of the annular body 211. During operation, in embodiments having the closed cell foam structure, a vacuum pressure is formed within the sealed volume 224 causing suction and undesirable sticking between the ELR 210 and the substrate 122. Alternatively, in embodiments where the bottom projection 220 structurally comprises an open cell foam, dynamic pressure equilibration occurs due to air flow from outside the ELR 210 to the sealed volume 224 through the open cell structure. The dynamic pressure equilibration provided by the open cell foam structure can release the suction and prevent the undesirable sticking between the ELR 210 and the substrate 122. In some embodiments described herein, addition of a venting feature, or plurality thereof, to the ELR 210 provides dynamic pressure equilibration even in embodiments where the bottom projection 220 structurally comprises the closed cell foam structure.

Figure 3A:
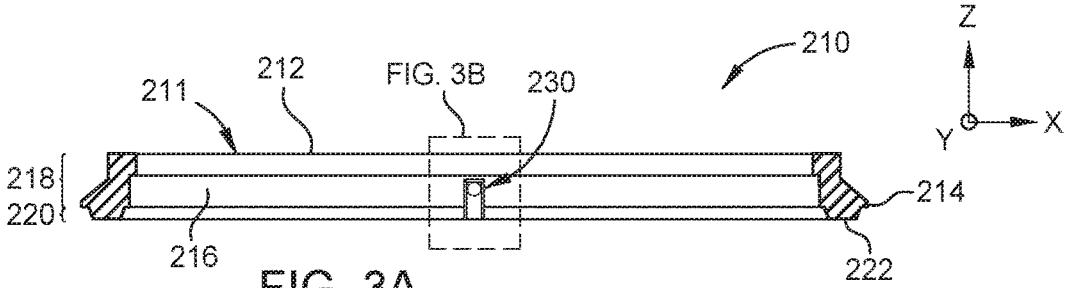
FIG. 3A is a side sectional view of one embodiment of an edge load ring (ELR) that may be used in the polishing head of FIG. 2A.
Figure 3D:
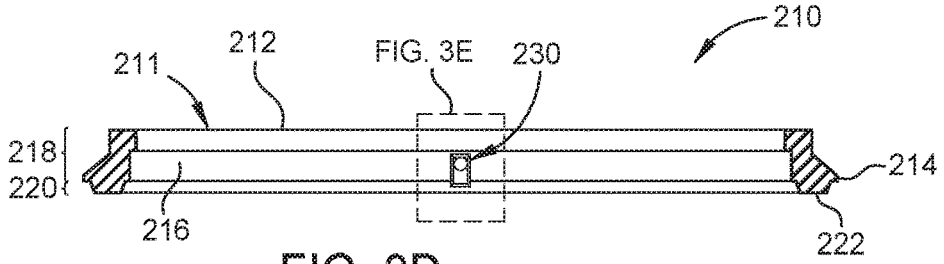
FIG. 3D is a side sectional view of another embodiment of an ELR that may be used in the polishing head of FIG. 2A.
Figure 3B:
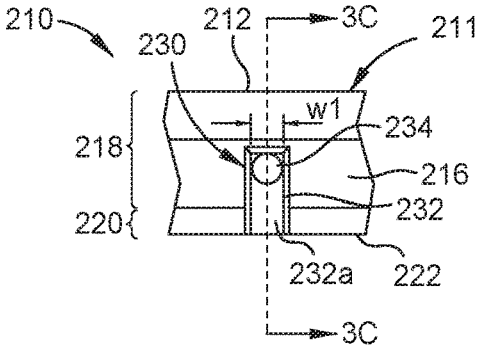
FIG. 3B is an enlarged side view of a portion of FIG. 3A.
Figure 3E:
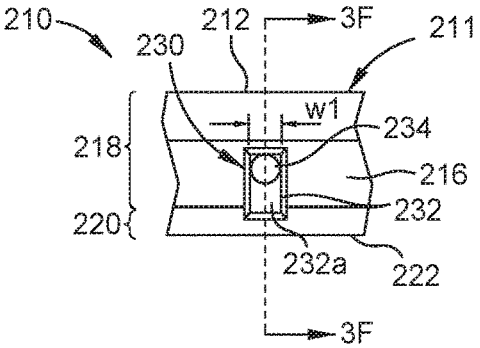
FIG. 3E is an enlarged side view of a portion of FIG. 3D.
Figure 3C:
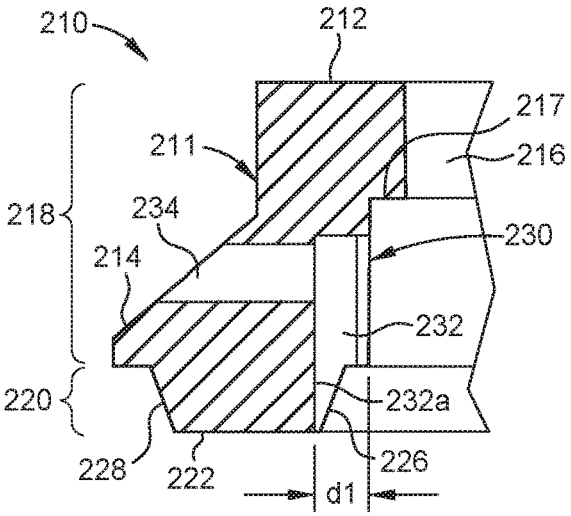
FIG. 3C is a side sectional view taken along section line 3C-3C of FIG. 3B.

FIG. 3A is a side sectional view of an ELR 210 having one or more vertical venting features 230. FIG. 3B is an enlarged side view of a portion of FIG. 3A. FIG. 3C is a side sectional view taken along section line 3C-3C of FIG. 3B. In some embodiments, the ELR 210 includes from 1 to 20 vertical features 230, such as from 1 to 10, such as from 1 to 5, such as from 1 to 3, such as one, two, or three vertical features 230. In one or more embodiments, the vertical features 230 are evenly spaced around the circumference of the ELR 210. In some other embodiments, the vertical features 230 are unevenly spaced. The vertical features 230 include a slot 232 formed in the inner surface 216 of the annular body 211. Here, a longitudinal axis of the slot 232 is orthogonal to the bottom surface 222, e.g., extending vertically. In some other embodiments, the longitudinal axis of the slot 232 is oriented at a different angle relative to the bottom surface 222, such as from about 60° to about 90° relative to the bottom surface 222. The vertical features 230 further include a passage 234 extending radially through the annular body 211 from the slot 232 to the outer surface 214. Here, a longitudinal axis of the passage 234 is orthogonal to the longitudinal axis of the slot 232 and parallel to the bottom surface 222, e.g. extending horizontally. In some other embodiments, the longitudinal axis of the passage 234 is oriented at a different angle relative to the bottom surface 222, such as from about 0° to about 30° relative to the bottom surface 222. Here, a cross-sectional area of the passage 234 is constant. In some other embodiments, a cross-sectional area of the passage 234 changes along the longitudinal axis thereof.

The slot 232 is formed in the inner surface 216. The slot 232 has a width w1 and depth d1. In some embodiments, the width w1 is about 60 mil or less, such as from about 20 mil to about 60 mil, such as from about 30 mil to about 50 mil. The slot 232 is adjacent to the vertical portion 117*a* of the membrane 117. In some embodiments when the membrane 117 is pressurized, the vertical portion 117*a* adjacent to the slot 232 can expand into and block the slot 232 thereby limiting or preventing pressure equalization. Beneficially, in embodiments where the slot 232 has a width w1 of about 60 mil or less, expansion of the membrane 117 into the slot 232 is relatively limited compared to embodiments having width w1 greater than about 60 mil. Here, the slot 232 has square corners along a back face 232*a* of the slot 232 to prevent the membrane 117 from conforming to the back face 232*a* when the membrane 117 expands into the slot 232. In some other embodiments, the corners along the back face 232*a* are rounded. The slot 232 has rounded corners where the slot 232 intersects the inner surface 216 to prevent damage to the membrane 117.

In some embodiments, the depth d1 is about 60 mil or less, such as from about 20 mil to about 60 mil, such as from about 30 mil to about 50 mil. In some embodiments, the width w1 and the depth d1 are about equal. In some other embodiments, the width w1 is greater than the depth d1. Here, the slot 232 has a rectangular cross-section in the x-y plane. In some other embodiments, the cross-section of the slot 232 may be square, round, e.g., circular, or another simple shape.

Figure 3F:
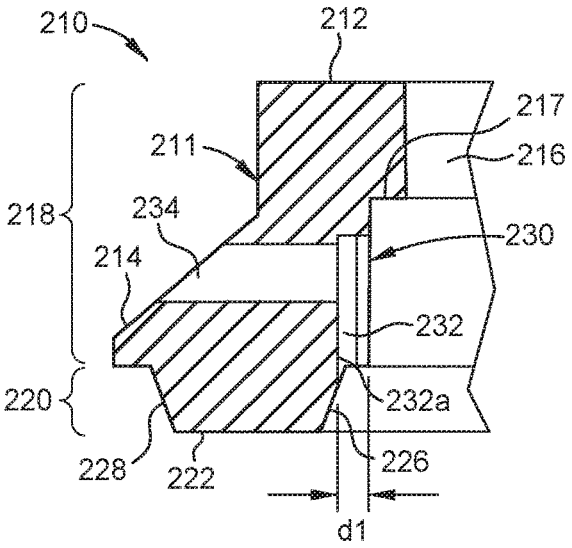
FIG. 3F is a side sectional view taken along section line 3F-3F of FIG. 3E.

Here, the slot 232 extends to the bottom surface 222 thereby disrupting the interface between the bottom surface 222 and the back side 122*b* when the ELR 210 is contacting the substrate 122. In such embodiments, disruption of the interface can cause non-uniform marking on the back side 122*b* due to stress concentration or scraping. Beneficially, in embodiments where the slot 232 has a depth d1 of about 60 mil or less, non-uniform marking is relatively limited compared to embodiments having depth d1 greater than about 60 mil. In some other embodiments illustrated in FIGS. 3D-3F, the slot 232 is formed in the inner surface 216, being open to the sealed volume 224, without extending to the bottom surface 222 such that the interface between the bottom surface 222 and the back side 122*b* of the substrate 122 is continuous. The inner surface 216 extends along the body portion 218 and the bottom projection 220 of the annular body 211. In some embodiments, the slot 232 is formed in the inner surface 216 of the body portion 218 without extending to a portion of the inner surface 216 along the bottom projection 220.

The passage 234 is formed radially through the annular body 211 between the back face 232*a* of the slot 232 and the outer surface 214. The passage 234 provides fluid communication and pressure equilibration to the sealed volume 224 from outside of the ELR 210. In some embodiments, a diameter of the passage 234 is about equal to or less than the width w1.

Figure 4A:
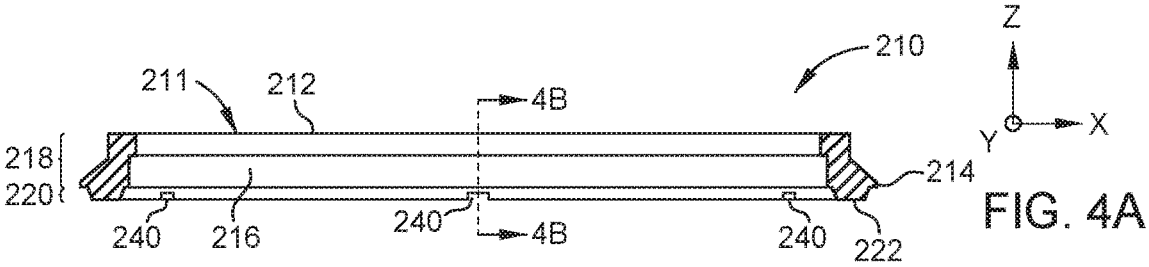
FIG. 4A is a side sectional view of yet another embodiment of an ELR that may be used in the polishing head of FIG. 2A.
Figure 4B:
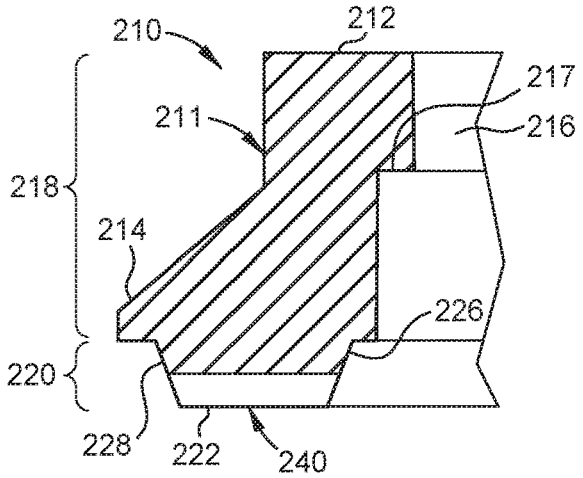
FIG. 4B is an enlarged side sectional view taken along section line 4B-4B of FIG. 4A.
Figure 4C:
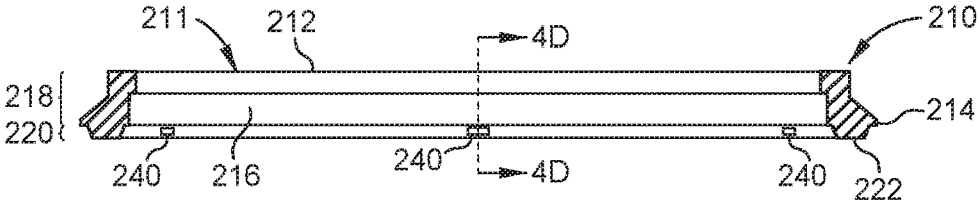
FIG. 4C is a side sectional view of yet another embodiment of an ELR that may be used in the polishing head of FIG. 2A.
Figure 4D:
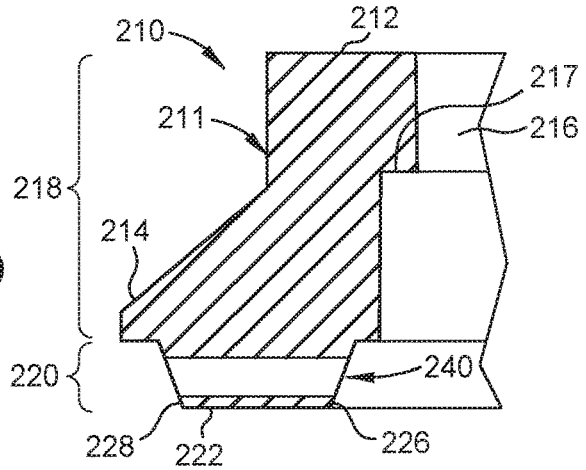
FIG. 4D is an enlarged side sectional view taken along section line 4D-4D of FIG. 4C.
Figure 4E:
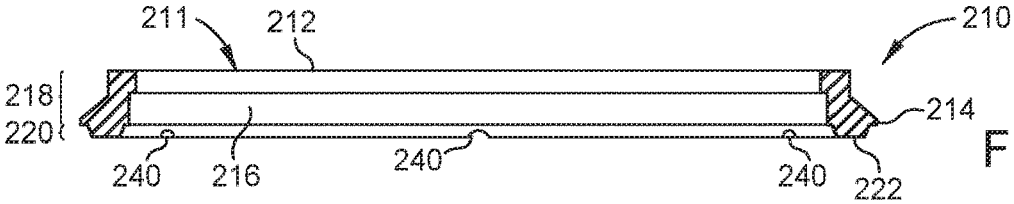
FIG. 4E is a side sectional view of yet another embodiment of an ELR that may be used in the polishing head of FIG. 2A.

FIG. 4A is a side sectional view of an ELR 210 where the bottom projection 220 includes a plurality of horizontal venting features 240. FIG. 4B is an enlarged side sectional view taken along section line 4B-4B of FIG. 4A. In the embodiment illustrated in FIGS. 4A-4B, the horizontal features 240 are formed in the bottom surface 222. In some other embodiments, the horizontal features 240 extend through the inner surface 216, being open to the sealed volume 224, without extending to the bottom surface 222 (FIGS. 4C-4D). The horizontal features 240 are formed radially through the annular body 211 between the inner and outer surfaces 216, 214. The horizontal features 240 provide fluid communication and pressure equilibration to the sealed volume 224 from outside of the ELR 210. Here, the ELR 210 includes five horizontal features 240 which are evenly spaced around the circumference. It will be appreciated that only three such horizontal features 240 are shown in the sectional views of FIGS. 4A and 4C. In some other embodiments, the bottom projection 220 includes from 1 to 20 horizontal features 240, such as from 1 to 10, such as from 1 to 5, such as from 1 to 3, such as one, two, or three horizontal features 240. In one or more embodiments, the horizontal features 240 are evenly spaced around the circumference of the ELR 210. In some other embodiments, the horizontal features 240 are unevenly spaced. In the embodiments illustrated in FIGS. 4A-4D, the horizontal features 240 are rectangular. In some other embodiments, the horizontal features 240 are rounded, e.g., circular (FIG. 4E), or have another simple shape. Here, a longitudinal axis of the horizontal feature 240 is parallel to the bottom surface 222, e.g. extending horizontally. In some other embodiments, the longitudinal axis of the horizontal feature 240 is oriented at a different angle relative to the bottom surface 222, such as from about 0° to about 30° relative to the bottom surface 222. Here, a cross-sectional area of the horizontal feature 240 is constant. In some other embodiments, a cross-sectional area of the horizontal feature 240 changes along the longitudinal axis thereof.

In operation, polishing a substrate 122 disposed in the polishing head 110 includes rotating the polishing head 110 relative to the polishing pad 106. During the rotating, the carrier chamber 119 of the polishing head 110 is pressurized, thereby forcing the annular body 211 of the ELR 210 against the substrate 122. The bottom projection 220 of the annular body 211 engages the back side 122*b* of the substrate 122. During the operation, pressure is equalized between the inner and outer surfaces 216, 214 of the annular body 211 by providing fluid communication through one or more vertical or horizontal venting feature 230, 240 extending between the inner and outer surfaces 216, 214. In some embodiments, equalizing pressure between the inner and outer surfaces 216, 214 includes increasing a pressure of the sealed volume 224 formed between the inner surface 216, the substrate 122, and the membrane 117.

While the foregoing is directed to embodiments of the present disclosure, other and further embodiments of the disclosure may be devised without departing from the basic scope thereof, and the scope thereof is determined by the claims that follow.

What is claimed is:

1. An edge load ring (ELR) configured to fit inside a retaining ring of a chemical mechanical polishing (CMP) head, the ELR comprising:

an annular body including:

an inner surface;

an outer surface opposite the inner surface, the outer surface having a diameter configured to slip inside the retaining ring;

a body portion;

a bottom projection extending below the body portion, the bottom projection having a bottom surface facing away from the body portion, the bottom surface configured to contact a substrate; and a venting feature formed through the annular body, the venting feature being in fluid communication between the inner and outer surfaces.

2. The ELR of claim 1, wherein the body portion and the bottom projection are separately formed and coupled together, wherein the body portion comprises a metal, and wherein the bottom projection comprises a plastic.

3. The ELR of claim 2, wherein the bottom projection is coupled to the body portion using at least one of an adhesive or a plurality of fasteners.

4. The ELR of claim 1, wherein the body portion and the bottom projection are integrally formed.

5. The ELR of claim 1, wherein the bottom projection comprises a plurality of projections.

6. The ELR of claim 1, wherein:

the body portion is formed from a first material;

the bottom projection is formed from a second material different from the first material; and the first material has a first hardness, and wherein the second material has a second hardness less than the first hardness.

7. The ELR of claim 1, wherein the venting feature comprises:

a slot formed in the inner surface; and a passage extending radially through the annular body from the slot to the outer surface.

8. The ELR of claim 7, wherein a longitudinal axis of the slot is orthogonal to the bottom surface, and wherein a longitudinal axis of the passage is orthogonal to the longitudinal axis of the slot.

9. The ELR of claim 7, wherein the slot is formed in the inner surface of the body portion without extending to a portion of the inner surface along the bottom projection.

10. The ELR of claim 7, wherein the slot has a width of about 60 mil or less.

11. The ELR of claim 1, wherein the venting feature is formed in the bottom projection without extending to the body portion, and wherein the venting feature extends through the bottom surface.

12. The ELR of claim 1, wherein the venting feature is formed in the bottom projection without extending to the body portion, and wherein the venting feature extends through the inner surface without extending to the bottom surface.

13. An edge load ring (ELR) configured to fit inside a retaining ring of a chemical mechanical polishing (CMP) head, the ELR comprising:

an annular body including:

an inner surface having a step configured to retain the annular body within the polishing head;

an outer surface opposite the inner surface, the outer surface having a diameter configured to slip inside the retaining ring;

a bottom surface extending between the inner and outer surfaces, the bottom surface configured to contact a substrate disposed in the polishing head;

an inner taper extending from the inner surface to the bottom surface;

an outer taper extending from the outer surface to the bottom surface; and a venting feature extending between the inner and outer surfaces.

14. The ELR of claim 13, wherein the venting feature is configured to be in fluid communication with a sealed volume formed between the substrate, the inner surface, and a membrane in contact with the inner surface.

15. The ELR of claim 13, wherein the annular body further comprises:

a body portion, wherein the body portion is formed from a first material having a first hardness, the first material having a tensile modulus of about 2,500 MPa or greater; and a bottom projection extending below the body portion, wherein the bottom projection is formed from a second material having a second hardness less than the first hardness.

16. The ELR of claim 15, wherein the bottom surface is configured to contact a back side of the substrate, wherein the first hardness is greater than a hardness of the back side, and wherein the second hardness is equal to or less than the hardness of the back side.

17. The ELR of claim 15, wherein the body portion and the bottom projection are separately formed and coupled together, wherein the first material comprises a metal, and wherein the second material comprises a plastic.

18. A polishing head, comprising:

a housing;

a retaining ring coupled to the housing;

a membrane coupled to the housing inside the retaining ring, the membrane and the retaining ring forming a substrate-receiving pocket; and an edge load ring (ELR) disposed radially between the membrane and the retaining ring, the ELR including an annular body, the annular body having:

an inner surface having a step configured to retain the annular body within the polishing head;

an outer surface opposite the inner surface, the outer surface having a diameter configured to slip inside the retaining ring;

a bottom surface extending between the inner and outer surfaces, the bottom surface configured to contact a substrate disposed in the substrate-receiving pocket, wherein the substrate extends radially to the retaining ring; and a venting feature extending between the inner and outer surfaces.

19. The polishing head of claim 18, wherein the venting feature comprises:

a slot formed in the inner surface; and a passage extending radially through the annular body from the slot to the outer surface.

20. The polishing head of claim 18, wherein the annular body further comprises:

a body portion, wherein the body portion is formed from a first material having a first hardness; and a bottom projection extending below the body portion, wherein the bottom projection is formed from a second material having a second hardness less than the first hardness, wherein the venting feature is formed in the bottom projection without extending to the body portion, and wherein the venting feature extends through the bottom surface.

* * * * *